US011215194B2

(12) United States Patent
Kim et al.

(10) Patent No.: US 11,215,194 B2
(45) Date of Patent: Jan. 4, 2022

(54) WASHING MACHINE

(71) Applicant: LG Electronics Inc., Seoul (KR)

(72) Inventors: Kwanghyun Kim, Seoul (KR); Hansol Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 204 days.

(21) Appl. No.: 16/454,967

(22) Filed: Jun. 27, 2019

(65) Prior Publication Data

US 2020/0002876 A1 Jan. 2, 2020

(30) Foreign Application Priority Data

Jun. 27, 2018 (KR) ..... 10-2018-0074394
Jun. 25, 2019 (KR) ..... 10-2019-0075430

(51) Int. Cl.
*D06F 39/08* (2006.01)
*F04D 29/42* (2006.01)

(52) U.S. Cl.
CPC ..... *F04D 29/426* (2013.01); *D06F 39/085* (2013.01); *D06F 39/083* (2013.01); *D06F 39/088* (2013.01)

(58) Field of Classification Search
CPC ..... D06F 39/088; D06F 39/085; D06F 39/12; F04D 29/426
USPC ..... 68/12.19
See application file for complete search history.

(56) References Cited

U.S. PATENT DOCUMENTS

2016/0130740 A1* 5/2016 Im ..... D06F 39/028 68/17 R
2017/0356120 A1* 12/2017 Choi ..... D06F 39/088

* cited by examiner

*Primary Examiner* — Tinsae B Ayalew
(74) *Attorney, Agent, or Firm* — Fish & Richardson P.C.

(57) ABSTRACT

A washing machine includes a tub, a drum, a nozzle, a pump for circulating water from the tub, and circulation pipes for guiding water. The pump includes a pump motor, an impeller, and a pump housing including first and second circulation ports. The pump housing includes a rotating water current guide part and a biased water current guide part on an inner circumferential surface. The rotating water current guide part extends in a rotation direction of the impeller from a cut-off point that braches water into a first flow running along the rotation direction and a second flow running toward the first circulation port, and guides the first flow to the second circulation port. The biased water current guide part extends from the cut-off point to the first circulation port with an angle greater than 180° relative to the rotating water current guide part, and guides the second flow.

20 Claims, 9 Drawing Sheets

WASHING MACHINE

CROSS-REFERENCE TO RELATED APPLICATIONS

This application claims the priority benefit of Korean Application No. 10-2019-0075430, filed on Jun. 25, 2019, and Korean Application No. 10-2018-0074394, filed on Jun. 27, 2018. The disclosures of the prior applications are incorporated by reference in their entirety.

BACKGROUND OF THE INVENTION

1. Field of the Invention

The present invention relates to a washing machine and more particularly to a washing machine having nozzles configured to spray water, discharged from a tub and circulating along a circulation pipe, into a drum.

2. Description of the Related Art

In general, a washing machine is an apparatus for removing a contaminant adhered to clothes, bedding, etc. (hereinafter, referred to as 'the laundry') using a chemical disintegration of water and a detergent and a physical operation such as a friction between water and the laundry.

Such a washing machine includes a tub containing water, and a drum rotatably provided in the tub to receive laundry. There are recently developed washing machines configured to circulate water discharged from the tub using a circulation pump, and to spray the circulated water (hereinafter, referred to as "circulating water") into the drum through nozzles.

In order to spray circulating water into the drum in multiple directions, a structure where the nozzle is provided in plural may be considered.

Korean Patent Application Publication No. 10-2014-0030187 (hereinafter, referred to as Related Art) discloses a washing machine including two nozzles at a gasket and a pump configured to supply circulating water to the two nozzles at the same time. The pump pumps water, discharged through a tub through a drain bellows, to a pair of circulation horses respectively connected to the pair of the nozzles at the same time, and accordingly, once the pump operates, water is sprayed through the pair of nozzles at the same time.

Specifically, the pump may include an impeller capable of being rotated by a motor, and a pump housing in which the impeller is housed. The pump housing includes a pair of discharge outlets through which water pumped by rotation of the impeller is discharged, and the pair of discharge outlets is connected to the pair of circulation horses, respectively.

In order to uniformly control an amount of water to be sprayed through the respective nozzles, an equal amount of water should be discharged through the pair of outlet ports. However, one of the pair of discharge outlets located at upper streams in a direction of rotation of the impeller discharges water at a relatively high flow rate, and thus, there are difficulties in discharging water at the same flow rate through the pair of nozzles.

Further, if the motor is not capable of controlling a direction of rotation thereof and the direction of rotation of the motor is determined randomly at each driving operation, it is not possible to predict that a larger amount of water is discharged through which one of the nozzles.

SUMMARY OF THE INVENTION

An object of the present invention is to provide a washing machine capable of, when circulating water pumped by a pump is supplied to nozzles through a first distribution pipe and a second distribution pipe, distributing the water uniformly to the first distribution pipe and the second distribution pipe.

In particular, an object of the present invention is to compensate for an amount of water discharged through a first circulation port positioned at an a downstream side in a direction of rotation of an impeller so that water can be discharged uniformly through the first circulation port and a second circulation port positioned at an upstream side.

Objects of the present invention should not be limited to the aforementioned objects and other unmentioned objects will be clearly understood by those skilled in the art from the following description.

In a washing machine of the present invention, a first circulation port and a second circulation port are formed in a pump housing, and water (hereinafter, referred to as circulating water) is discharged through the first circulation port and the second circulation port upon rotation of the impeller.

A first nozzle for spraying circulating water, supplied through the first circulation, port into a drum, and a second nozzle for spraying circulating water, supplied through the second circulation, port into the drum are provided.

In the pump housing, a cut-off point is formed to branch water into a first flow to run along the direction of rotation of the impeller and a second flow to run toward an entrance hole of the first circulation port.

The inner circumferential surface includes a rotating water current guide part extending in the direction of rotation of the impeller, and a biased water current guide part extending from the rotating water current guide part toward the first circulation port. The biased water current guide part forms an angle greater than 180° relative to the rotating water current guide part.

The rotating water current guide part guides the first flow to the second circulation port, and the second flow is guided to the first circulation port by the biased water current guide part.

The biased water current guide part may extend from the cut-off point with a directional component opposite to the direction of rotation of the impeller. The cut-off point may be formed at a location spaced apart from the entrance hole of the first circulation port toward a center of rotation of the impeller.

The first circulation port and the second circulation port may extend in parallel with each other. The biased water current guide part may form, at the cut-off point, an acute angle relative to a line component parallel to the first circulation port in the direction of rotation of the impeller.

There may be provided a controller configured to control a direction of rotation of the pump motor.

In another aspect of the present invention, on the inner circumferential surface of the pump housing, an entrance hole of the first circulation port and an entrance hole of the second circulation port are disposed in an acute-angle area forming a predetermined acute angle relative to a center of rotation of the impeller on the inner circumferential surface A rotating water current guide part extends to the entrance hole of the second circulation port by passing through a reflex-angle area forming a reflex angle relative to the acute angle along the direction of rotation of the impeller from the cut-off point.

The biased water current guide part is bent at the cut-off point from the rotating water current guide part to thereby guide the second flow to the first circulation port.

the rotating water current guide part and the biased water current guide part may form an edge.

the biased water current guide part may extend in a direction in which a normal line and an obtuse angle are formed relative to the rotating water current guide part at the cut-off point.

In yet another aspect of the present invention, the first circulation port is disposed between the cut-off point and the second circulation port, and a distance from the center of rotation of the impeller is shorter than a distance from the center of rotation of the impeller to the first circulation port.

The details of other embodiments are included in the following description and the accompanying drawings.

According to a washing machine of the present invention, an amount of water to be discharged through a first circulation port is supplemented with water branched at a cut-off point formed in an inner circumferential surface of a pump housing, and the amount of water to be discharged through the first circulation port may be equal to an amount of water to be discharged through a second circulation port located at an upper stream side compared to the first circulation port.

Since water currents are guided with uniform pressure and volume through a first distribution pipe connected to the first circulation port and a second distribution pipe connected to the second circulation port, nozzles connected to the distribution pipes may spray water in a symmetrical shape. For example, if a first nozzle(s) connected to the first distribution pipe and a second nozzle(s) connected to the second distribution pipe are arranged symmetrically, water streams sprayed through the first nozzle(s) and the second nozzle(s) may be symmetrical.

Effects of the present invention should not be limited to the aforementioned effects and other unmentioned effects will be clearly understood by those skilled in the art from the claims.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
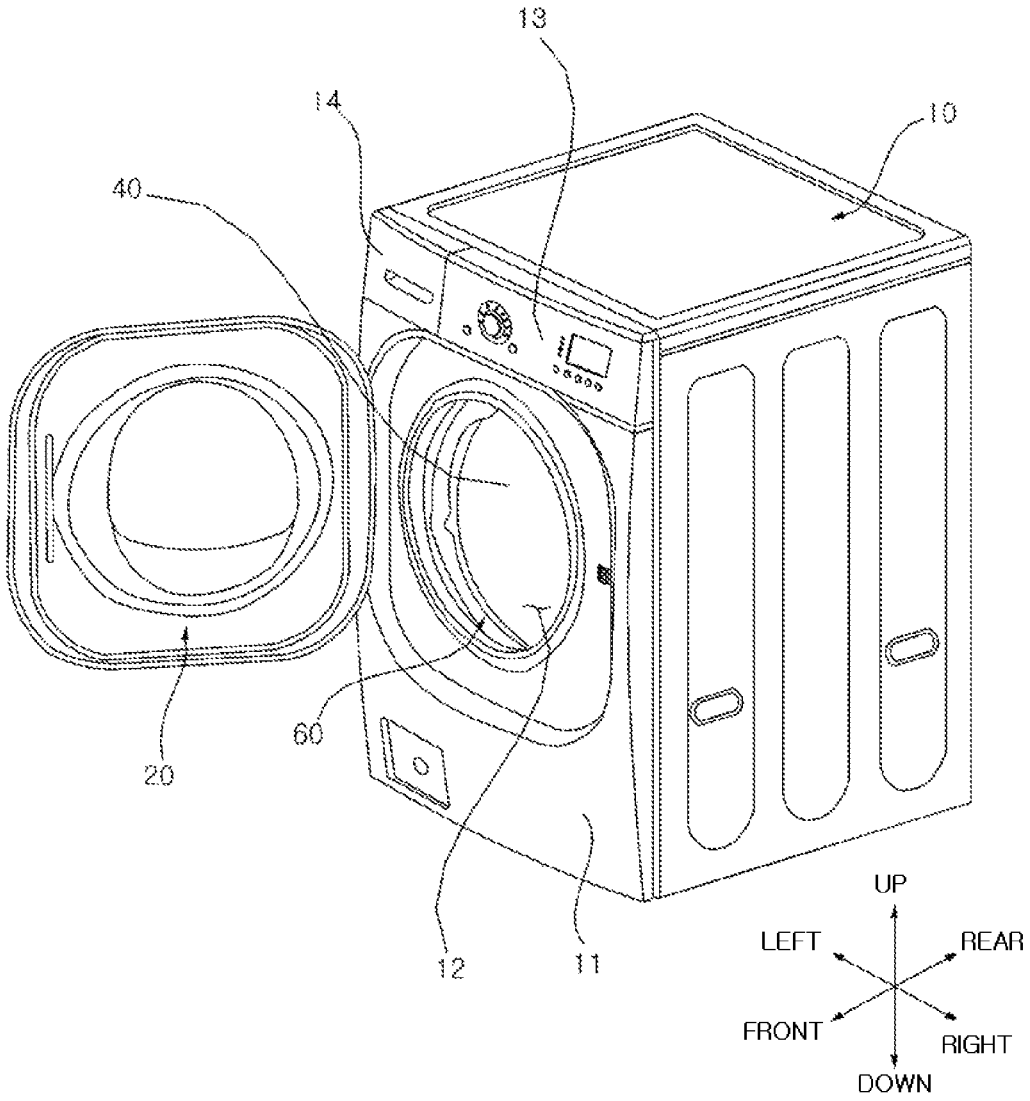
FIG. 1 is a perspective view of a washing machine according to an embodiment of the present invention.

Advantages and features of the present disclosure and methods to achieve them will become apparent from the descriptions of exemplary embodiments herein below with reference to the accompanying drawings. However, the present disclosure is not limited to exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined only by the claims. Like reference numerals denote like elements throughout the descriptions.

Figure 2:
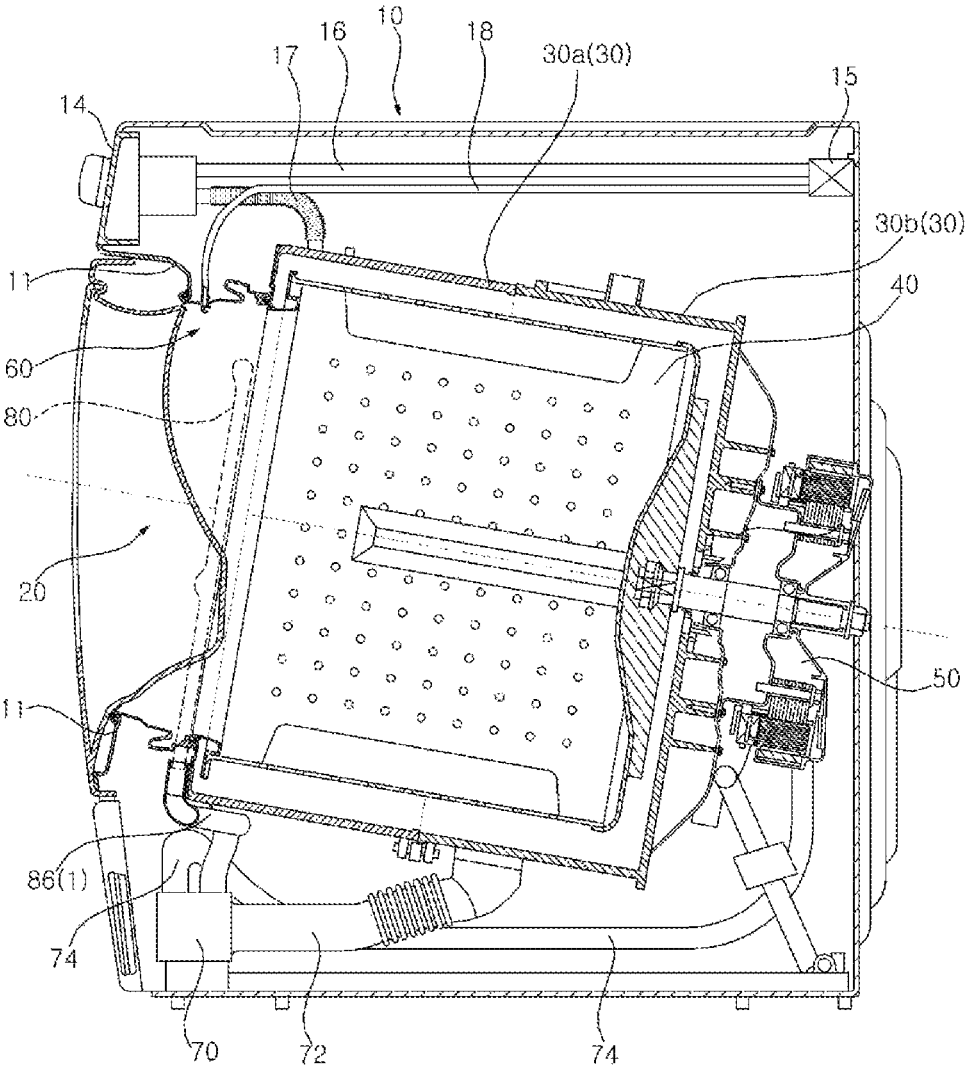
FIG. 2 is a side cross-sectional view of the washing machine shown in FIG. 1.
Figure 3:
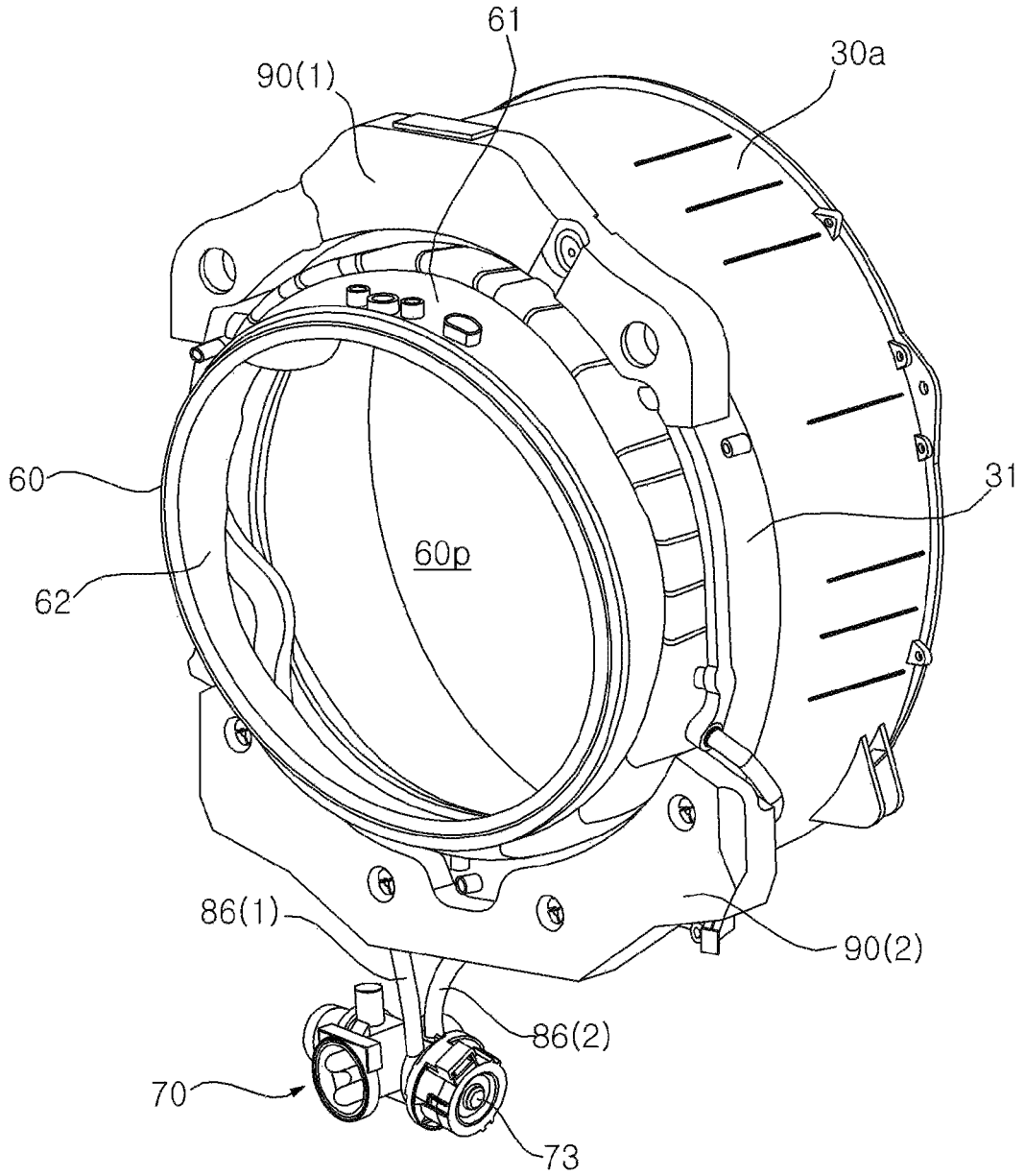
FIG. 3 illustrates an assembly in which a distribution pipe is installed at a gasket.
Figure 4:
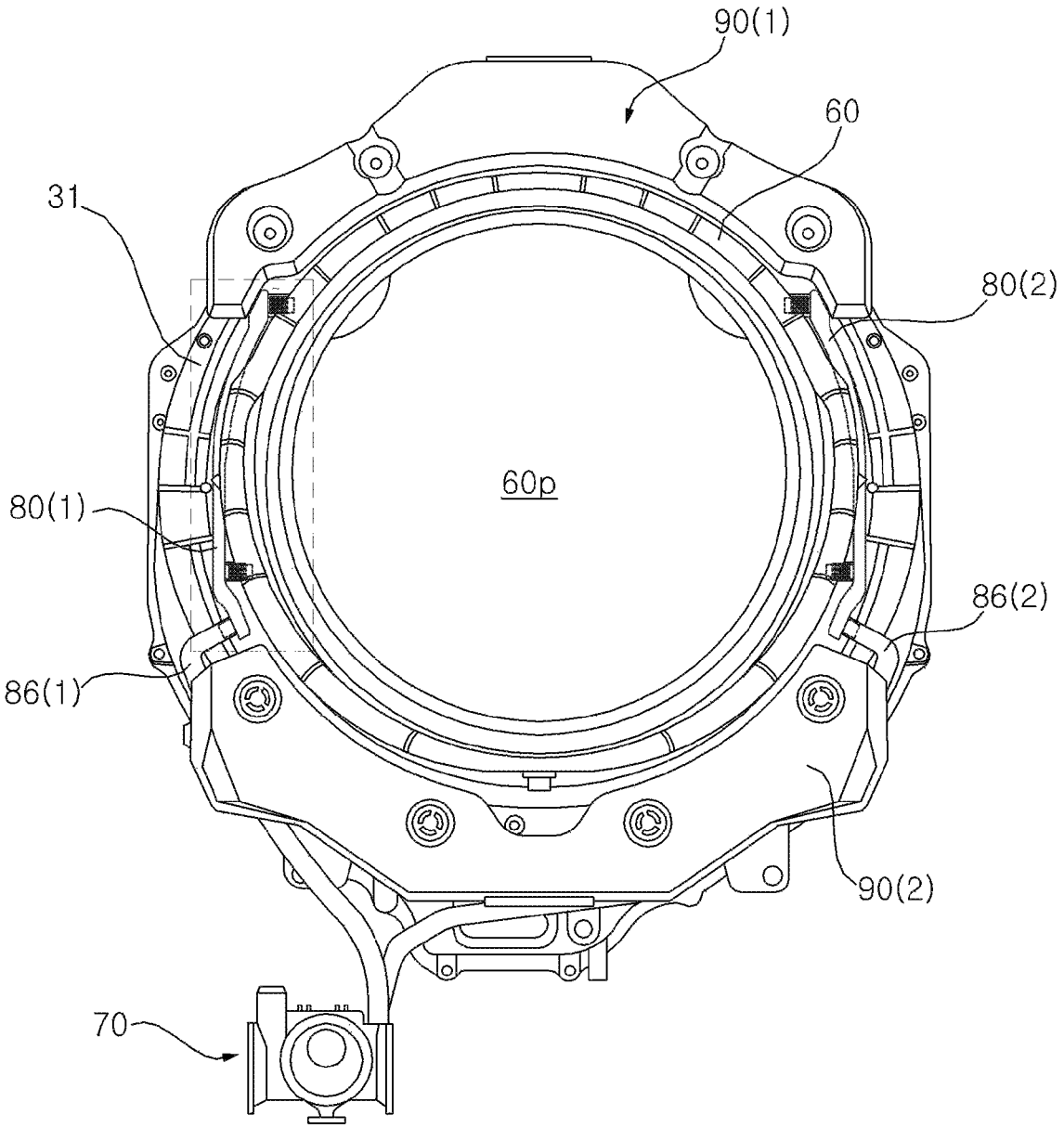
FIG. 4 illustrates the configuration of the assembly, shown in FIG. 3, from the front.
Figure 5:
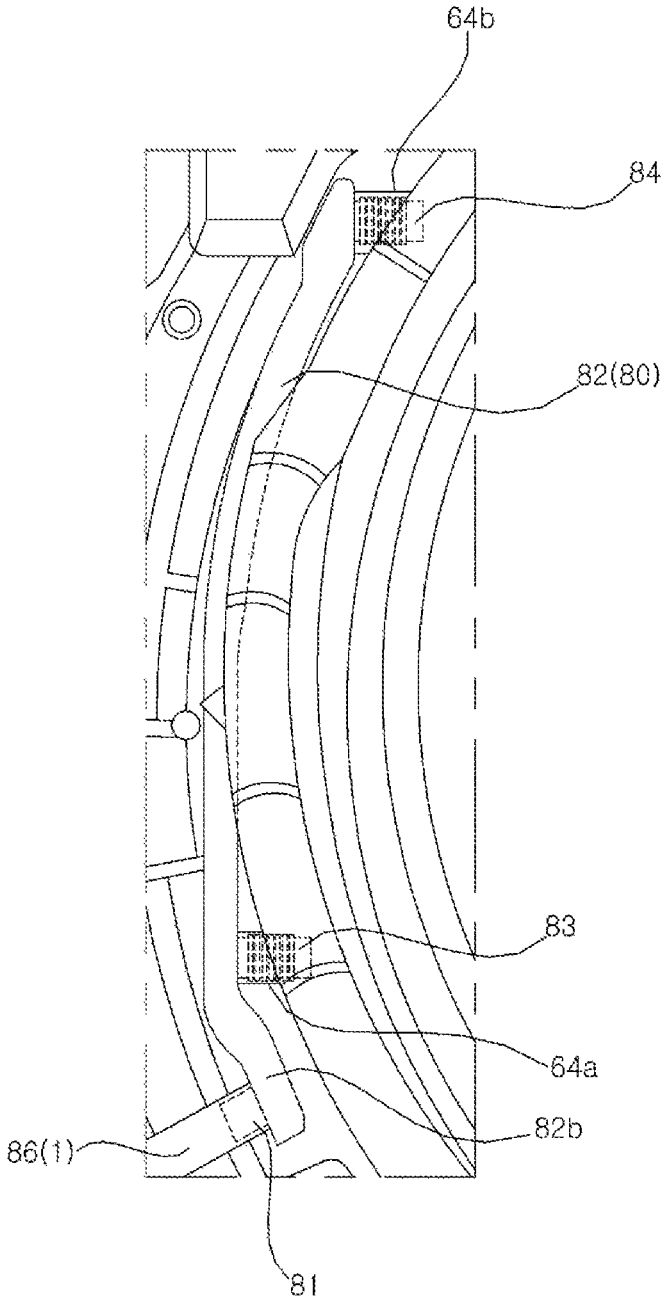
FIG. 5 is an enlarged view of a portion marked with a dotted line in FIG. 4.
Figure 6:
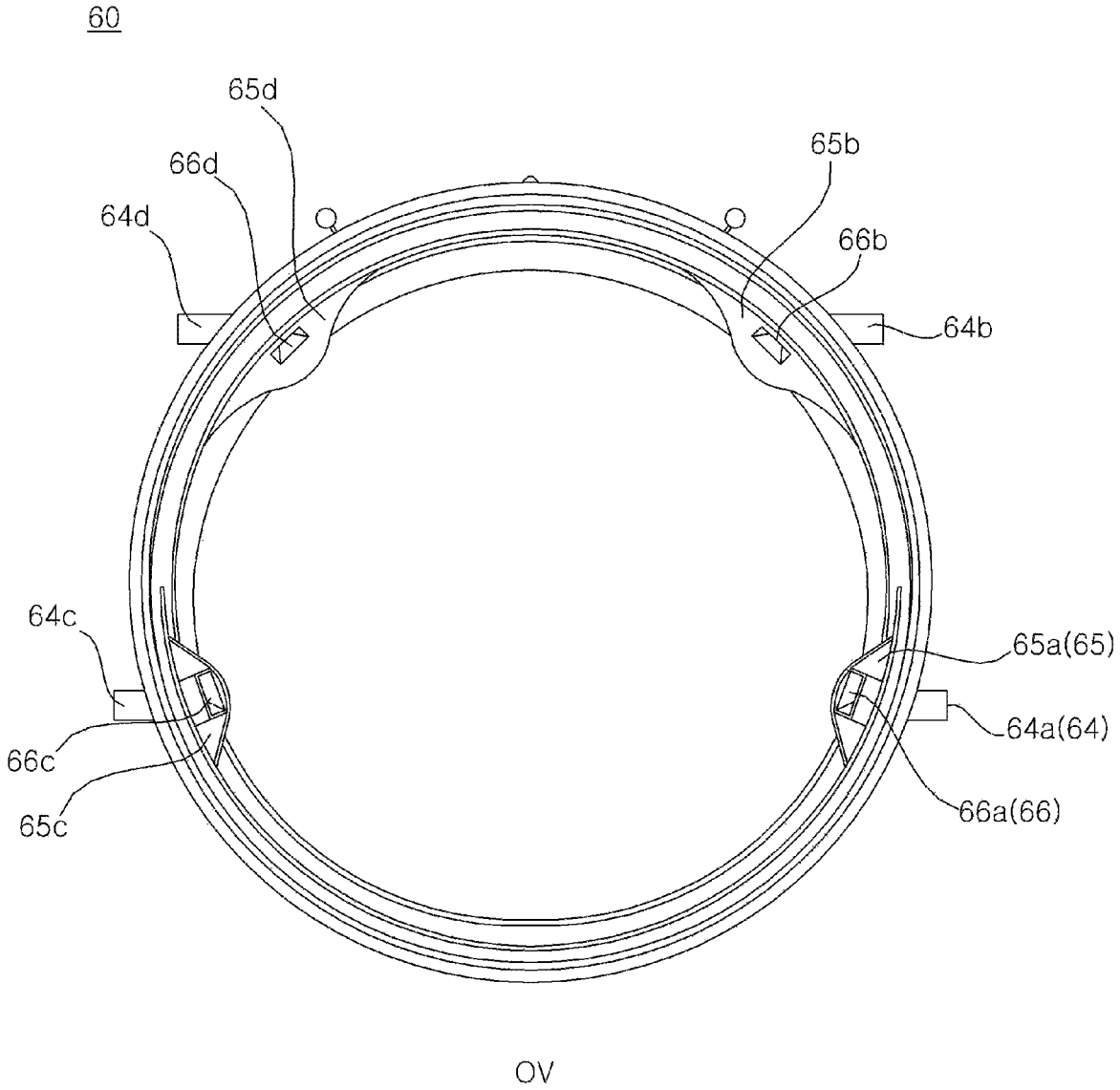
FIG. 6 illustrates the configuration of a gasket from the rear.
Figure 7:
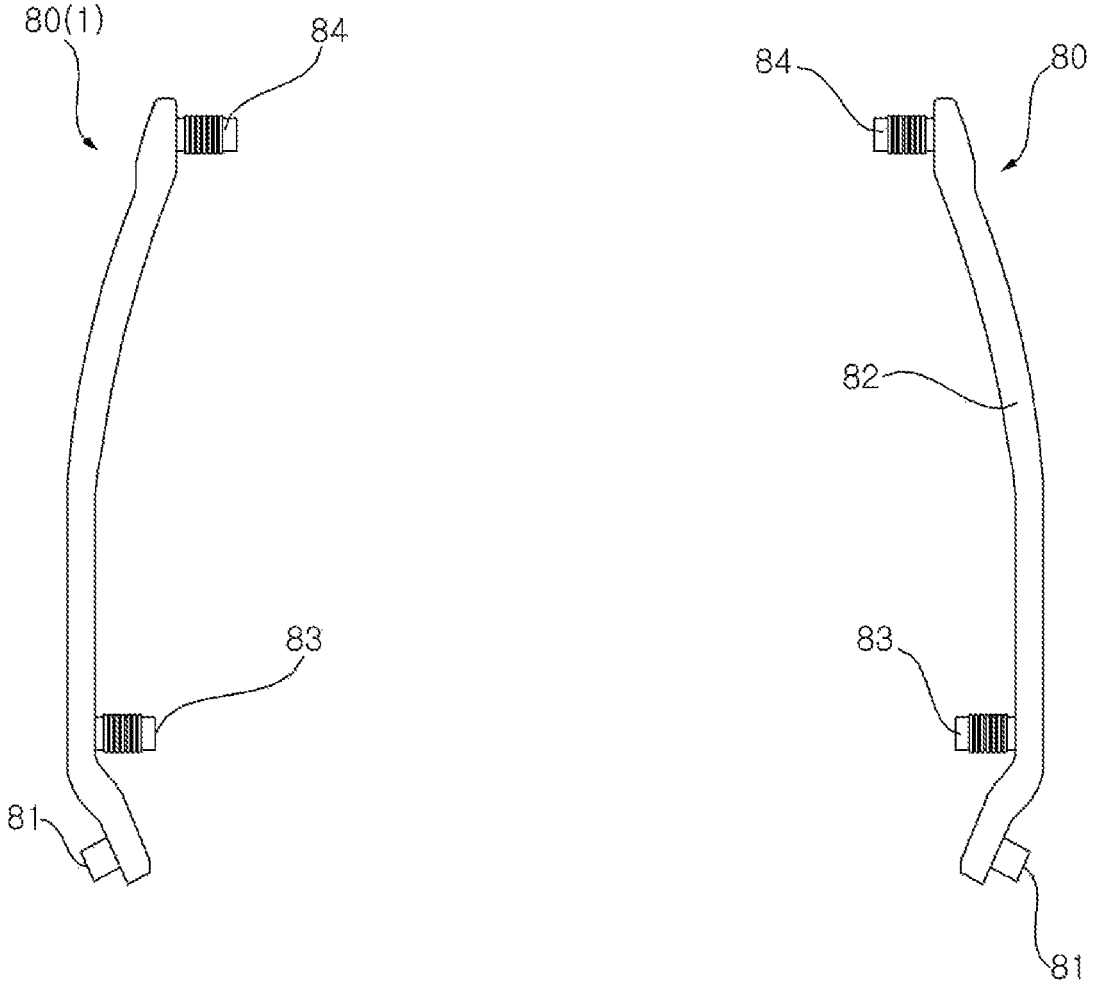
FIG. 7 is a front view of a first distribution pipe and a second distribution pipe.
Figure 8:
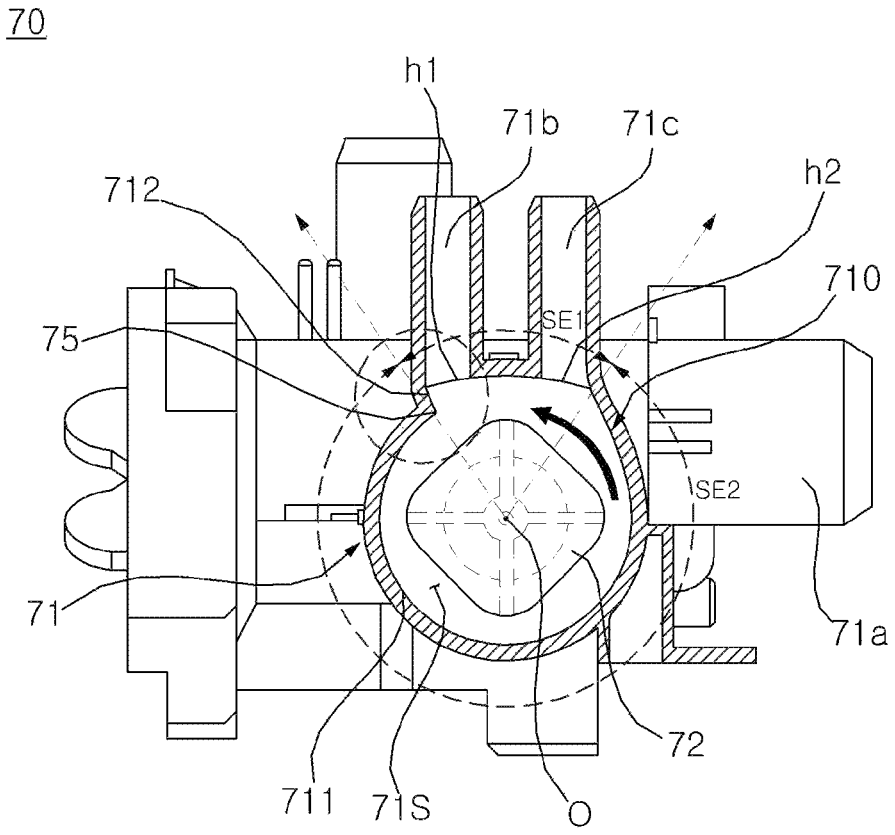
FIG. 8 is a partial cut-away view of a pump.
Figure 9:
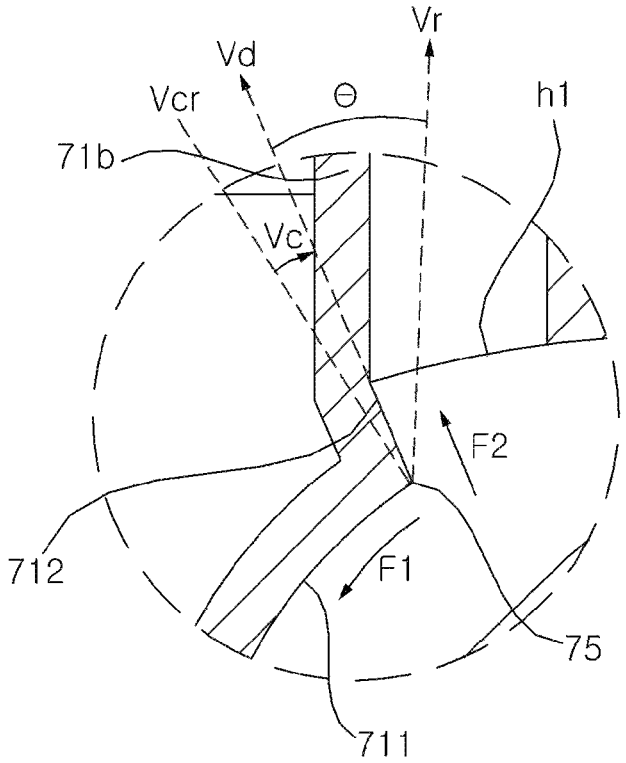
FIG. 9 is an enlarged view of a portion marked with a dotted line in FIG. 8.

FIG. 1 is a perspective view of a washing machine according to an embodiment of the present invention. FIG. 2 is a side cross-sectional view of the washing machine shown in FIG. 1. FIG. 3 illustrates an assembly in which a distribution pipe is installed at a gasket. FIG. 4 illustrates the configuration of the assembly, shown in FIG. 3, from the front. FIG. 5 is an enlarged view of a portion marked with a dotted line in FIG. 4. FIG. 6 illustrates the configuration of a gasket from the rear. FIG. 7 is a front view of a first distribution pipe and a second distribution pipe. FIG. 8 is a partial cut-away view of a pump. FIG. 9 is an enlarged view of a portion marked with a dotted line in FIG. 8.

Referring to FIGS. 1 and 3, a washing machine according to an embodiment of the present invention includes a casing 10 forming an exterior appearance of the washing machine, a tub 30 disposed in the casing 10 and containing wash water, a drum 40 rotatably installed in the tub 30 and receiving laundry, and a motor 50 rotating the drum 40.

A front panel 11 having a laundry entry hole 12 formed therein may be disposed at front of the casing 10. A door 20 for opening and closing the laundry entry hole 12, and a dispenser 14 to which detergent is introduced may be installed at the front panel 11.

In addition, a water supply valve 15, a water supply pipe 16, and a water supply horse 17 may be installed inside the casing 10. Upon a water supply, wash water having passed through the water supply valve 15 and the water supply pipe 16 may be mixed with detergent in the dispenser 14 and then supplied to the tub 30 through the water supply horse 17.

Meanwhile, a direct water supply pipe 18 may be connected to the water supply valve 15 so that wash water is not mixed with detergent but supplied directly to the tub 30 through the direct water supply pipe 18. There may be provided a direct nozzle 19 for spraying water, supplied through the direct water supply pipe 18, into the drum 40.

Referring to FIGS. 2 to 4, there are provided a first distribution pipe 80(1) and a second distribution pipe 80(2), which are for guiding water pumped by a pump 70. The first distribution pipe 80(1) and the second distribution pipe 80(2) may be provided on both sides of a gasket 60, respectively.

The distribution pipes 80(1) and 80(2) may be formed of synthetic resin that is harder or stiffer than the gasket 60. The distribution pipes 80(1) and 80(2) maintains a predetermined shape in spite of vibration occurring during operation of the washing machine, and the distribution pipes 80(1) and 80(2) are rigid relative to the gasket 60, which is so flexible to transforms in response to vibration of the tub 30.

In addition, circulation pipes 86(*a*) and 86(2) may be so flexible to transform in response to vibration of the tub 30. In this case, the distribution pipes 80(1) and 80(2) may be formed of synthetic resin that is more solid or stiffer than the circulation pipes 86(1) and 86(2).

The pump 70 and the tub 30 are connected via a discharge horse 72, and the first distribution pipe 80(1) and the second distribution pipe 80(2) are connected to the pump 70 by the first circulation pipe 86(1) and the second circulation pipe 86(2). The pump 70 includes a first circulation port 71*b* connected to the first circulation pipe 86(1), and a second circulation port 71*c* connected to the second circulation pipe 86(2).

When the pump 70 operates, wash water contained in the tub 30 may be sprayed into the drum 40 through the first distribution pipe 80(1) and the second distribution pipe 80(2) such that the wash water circulates. The pump 70 may be connected to a drain pipe 74 to thereby discharge the wash water to the outside through the drain pipe 74.

The above-described pump 70 functions as a circulation pump for circulating pump and as a drain pump for discharging wash water. On the contrary, the circulation pump and the drain pump may be installed separately. In the case where the circulation pump and the drain pump are installed separately, it is obvious that the drain pipe 74 is connected to the drain pump and that the first circulation pipe 86(1) and the second circulation pipe 86(2) are connected to the circulation pump.

Meanwhile, the tub 30 may be formed as a single tub body or may be formed as a first tub body 30*a* and a second tub body 30*b* are fastened to each other. Regarding the embodiment of the present invention, the example in which the first tub body 39*a* and the second tub body 30*b* are fastened to form the tub 30 is described. Hereinafter, the first tub body 30*a* will be referred to merely as a "tub" 30.

An opening is formed on a front surface 31 of the tub 30 to correspond to the laundry entry hole 12 formed in the front panel 11. The gasket 60 is disposed between an edge of the laundry entry hole 12 formed in the front panel 11, the edge which defines the laundry entry hole 12, and an edge of the tub 30, the edge which defines the opening. The gasket 60 is formed of a flexible substance such as rubber and has an approximate cylindrical shape. For example, the gasket 60 may be formed of a substance such as Ethylene Propylene Diene Monomer (EPDM), Thermo Plastic Elastomer (TPE), or the like, but aspects of the present invention are not limited thereto.

A front edge of the gasket 60 is connected to the edge of the laundry entry hole 12, and a rear edge of the gasket 60 is connected to the edge of the opening of the tub 30, thereby sealing between the tub 30 and the front panel 11. The door 20 and a front end of the gasket 60 are tightly brought into contact in the state in which the door 20 is closed, sealing between the door 20 and the gasket 60 to thereby prevent a leakage of water wash.

Referring to FIGS. 4 to 6, the first and second distribution pipes 80 are installed at the gasket 60. At least one balancer 90 may be fastened to the front surface 31 of the tub 30. A first balancer 90(1) may be disposed over the front surface 31, and a second balancer 90(2) may be disposed under the front surface 31.

A pipe 80 may include an inlet port 81 through which water discharged from the pump 70 is introduced, a transport conduit 82 which guides the water introduced through the inlet port 81, and a plurality of outlet ports 83 and 84 which are branched from the transport conduit 82.

Through the inlet port 81, water discharged from the pump 70 is introduced. The inlet port 81 may be connected to the pump 70 by the circulation pipe 86(1). The pump 70 may include a circulation port through which circulating water is discharged, and the number of which corresponds to the number of the distribution pipes 80. In the present embodiments, the pump 70 includes a first circulation port and a second circulation port, wherein the first circulation port is connected to an inlet port 81 of the first distribution pipe 80(1) by the first circulation pipe 86(1) and the second circulation port is connected to an inlet port 81 of the second distribution pipe 80(2) by the second circulation pipe 86(2).

The transport conduit 82 is positioned external to a passage 60P defined by the gasket 60, and guides water, introduced through the inlet port 81, in an upward direction. The transport conduit 82 constitutes a flow path communicating with the inlet port 81, and the flow path may be bent in a shape approximately corresponding to an outer circumferential surface of the gasket 60 and extends in an up-down direction.

The plurality of outlet ports 83 and 84 are branched from the transport conduit 82. Circulating water transported along the transport conduit 82 is discharged through the plurality of outlet ports 83 and 84. The outlet ports 83 and 84 are branched from the transport conduit 82 from above the inlet port 81. That is, an entrance hole of each of the outlet ports 83 and 84 (which is a portion of each of the outlet ports 83 and 84 being connected to the transport conduit 82) is located further higher than the exit of the inlet port 81 (which is a portion of the inlet port 81 being connected to the transport conduit 82).

The plurality of outlet ports 83 and 84 includes two outlet ports 83 and 84 formed at different heights. Hereinafter, a lower outlet port in the two outlet ports 83 and 84 is referred to as a lower outlet port 83, and the other outlet port located higher than the lower outlet port 83 is referred to as an upper outlet port 84.

First to fourth port receiving pipes 64*a*, 64*b*, 64*c*, and 64*d* may be formed on an outer circumferential surface 61 of the gasket 60 to protrude outwardly so as to correspond to four outlet ports 83 and 84, respectively. The four outlet ports 83 and 84 may be inserted into and connected to the first to fourth port receiving pipes 64*a*, 64*b*, 64*c*, and 64*d*.

At least one pair of nozzles for spraying water into the drum 40 is provided. In the present embodiment, first to fourth nozzles 66*a*, 66*b*, 66*c*, and 66*d* respectively communicating with the first to fourth port receiving pipes 64*a*, 64*b*, 64*c*, and 64*d* are provided on an inner circumferential surface 62 of the gasket 60. In an embodiment of the present invention, the first to fourth nozzles 66*a*, 66*b*, 66*c*, and 66*d* are formed integrally with the integrally with the gasket 60. On the contrary, the first to fourth nozzles 66*a*, 66*b*, 66*c*, and 66*d* may be formed as components separately from the gasket 60 and coupled to the gasket 60 or may be separated from the gasket 60 and flow-path-connected to the first to fourth port receiving pipes 64*a*, 64*b*, 64*c*, and 64*d* via a separate flow path connecting member (not shown).

First to Fourth protrusions 65*a*, 65*b*, 65*c*, and 65*d* may protrude toward the interior of the gasket 60 from the inner circumferential surface 62 of the gasket 60, and the first to fourth nozzles 66*a*, 66*b*, 66*c*, and 66*d* may be formed at the first to fourth protrusions 65*a*, 65*b*, 65*c*, and 65*d*, respectively. Accordingly, circulating water discharged through the outlet ports 83 and 84 in the respective distribution piping 80(1) and 80(2) may be sprayed into the drum 40 through the first to fourth nozzles 66*a*, 66*b*, 66*c*, and 66*d*.

The number of each of port receiving pipes 64, protrusions 65, and nozzles 66, and positions thereof may be modified, as does the number of outlet ports 84.

The first to fourth nozzles 66*a*, 66*b*, 66*c*, and 66*d* may include nozzles 66*a* and 66*b* to which water is supplied through the first distribution piping 80(1), and nozzles 66*c* and 66*d* to which water is supplied through the second distribution pipe 80(2). Hereinafter, when necessary to distinguish, the nozzles to which water is supplied through the first distribution piping 80(1) are referred to as first nozzles 66*a* and 66*b*, and the nozzles to which water is supplied through the second distribution pipe 80(2) are referred to as second nozzles 66*c* and 66*d*.

In addition, among the nozzles 66*a* and 66*b* or 66*c* and 66*d* to which water is supplied through the distributing pipe 80(1) or 80(2), a nozzle at an upper position is an upper nozzle 66*b* or 66*d*, and a nozzle at a position lower than the upper nozzle 66*b* or 66*d* is a lower nozzle 66*a* or 66*c*. That is, a first lower nozzle 66*a* and a first upper nozzle 66*b*, to which water is supplied through the first distribution piping 80(1), and a second lower nozzle 66*c* and a second upper nozzle 66*d*, to which water is supplied through the second distribution piping 80(2), are provided in the gasket 60 in the present embodiment.

Referring to FIGS. 8 and 9, the pump 70 includes a pump housing 71, an impeller 72 disposed in the pump housing 71, and a pump motor 73 for providing a torque to rotate the impeller 72.

The pump motor 73 is capable of controlling a direction of rotation. For example, the pump motor 73 may be preferably, but not limited to, a Brushless Direct Current Motor (BLDG).

There may be provided a controller (not shown) that controls a direction of rotation of the pump motor 73. The controller may include a processor that accesses a medium, in which a program is recorded, to thereby perform computation according to the recorded program. Further, the controller may control not just the pump motor 73 but also other electronic components included in the washing machine.

The pump housing 71 forms a space 71*s* where the impeller 72 is housed. The pump housing 71 includes a water introducing port 71*a*, along which water discharged from the tub 30 is guided to the space 71*s*, and a first circulation port 71*b* and a second circulation port 71*c*, through which water pumped by the impeller 72 is discharged. The first circulation port 71*b* and the second circulation port 71*c* are connected to the first circulation pipe 86(1) and the second circulation pipe 86(2). Thus, a water current formed upon rotation of the impeller 72 by the pump motor 73 is discharged through the first circulation port 71*b* and the second circulation port 71*c* at the same time. In this case, water discharged through the first circulation port 71*b* is supplied to the first distribution pipe 80(1) through the first circulation pipe 86(1), and water discharged through the second circulation port 71*c* is supplied to the second distribution pipe 80(2) through the second circulation pipe 86(2).

In the pump housing 71, an inner circumferential surface 710 defining the space 71*s* includes a rotating water current guide part 711 and a biased current guide part 712. The rotating water current guide part 711 extends in a direction of rotation of the impeller 72 from a cut-off point 75, at which a first flow F1 running in the direction of rotation of the impeller 72 and a second flow F2 running toward the entrance hole of the first circulation port 71*b* are branched. The first circulation port 71*b* is disposed between the cut-off point 75 and the second circulation port 71*c*, and a distance from the center of rotation O of the impeller 72 to the cut-off point 75 may be shorter than a distance from the center of rotation to the first circulation port 71*b*.

While extending along a circumference of the impeller 72, the rotating water current guide part 711 may form a curved surface that is rolled in the direction of rotation of the impeller, and the first flow F1 is guided to the second circulation port 71*c* by the rotating water current guide part 711.

While extending from the cut-off point 75, the biased water current guide part 712 may form an angle greater than 180° relative to the rotating water current guide part 711. The rotating water current guide part 711 and the biased water current guide part 712 may form an edge, respectively, and the edge may constitute the cut-off point 75.

The biased water current guide part 712 extends from the rotating water current guide part 711 in a direction Vd, which is biased from the radial direction Vcr in a direction opposite to the direction of rotation of the impeller 72, thereby guiding a water current (or the first flow F1) guided by the rotating water current guide part 711 to the first circulation port 71*b*.

Due to this structure, the second circulation port 71*c* discharges a first portion of the first flow F1, and the first circulation port 71*b* discharges an amount of water added with a second flow F2 that is branched at the cut-off point 75 in a second portion of water corresponding to the rest of the first flow F1.

Suppose that the cut-off point 75 does not exist, that the inner circumferential surface 710 is symmetric between the left and right sides, and that the impeller 72 rotates in a counter-clockwise direction with reference to FIG. 8. In this case, a portion of the rotating water current is discharged through the second circulation port 71*c* located at the upper stream of the water current, and the rest of the rotating water current is discharged through the first circulation port 71*b*. However, since the second circulation port 71*c* is at a location higher than the first circulation port 71*b* and almost in contact with the inner circumferential surface 710 of the pump housing 71, the amount of water discharged through the second circulation port 71*c* is larger than the amount of water discharged through the first circulation port 71*b*.

On the contrary, in the present invention, the second flow F2 branched at the cut-off point 75 is further discharged through the first circulation port 71*b*. Accordingly, it is possible to increase the discharge flowrate of the first circulation port 71*b*, compared to the conventional technology, and to reduce a deviation in the discharge flow rate between the first circulation port 71*b* and the second circulation port 71*c*.

Meanwhile, the cut-off point 75 may be formed at a location spaced apart from an entrance hole h1 of the first circulation port 71*b* toward the center of rotation O of the impeller 72. The biased water current guide part 712 may extend, from the cut-off point 75, with a component (which is a component of the direction Vc in FIG. 9) opposite to the direction of rotation of the impeller 72. In FIG. 9, Vcr indicates the radial direction from the cut-off point 75 (which is a line connecting the center of rotation O (see FIG. 8) of the impeller 72 and the cut-off point 75.

The first circulation port 71*b* and the second circulation port 71*c* may extend in parallel with each other. At the cut-off point 75, the biased water current guide part 712 may form an acute angle θ relative to a line component Vr, which is parallel to the first circulation port 71*b*, in the direction of rotation of the impeller 72.

On the inner circumferential surface 710 of the pump housing 71, an entrance hole h1 of the first circulation port 71*b* and an entrance hole h2 of the second circulation port 71*c* may be disposed in an acute-angle area SE1 that forms a predetermined acute angle relative to the center of rotation of the impeller 72. In this case, the rotating water current guide part 711 extends to the entrance hole h2 of the second circulation port 71*c* by passing through a reflex-angle area SE2, forming a reflex angle relative to the acute angle, along the direction of rotation of the impeller 72 from the cut-off point 75. In addition, the biased water current guide part 712 is bent at the cut-off point 75 to thereby guide the second flow F2 to the first circulation port 71*b*.

Although some embodiments have been described above, it should be understood that the present invention is not limited to these embodiments, and that various modifications, changes, alterations and variations can be made by those skilled in the art without departing from the spirit and scope of the invention. Therefore, it should be understood that the above embodiments are provided for illustration only and are not to be construed in any way as limiting the present invention.

What is claimed is:

1. A washing machine comprising:

a tub;

a drum rotatably disposed in the tub;

a first nozzle and a second nozzle that are configured to spray water into the drum;

a pump configured to circulate water discharged from the tub;

a first circulation pipe connected to the first nozzle and the pump; and a second circulation pipe connected to the second nozzle and the pump, wherein the pump comprises:

a impeller, a pump motor configured to rotate the impeller, a water introducing port connected to the tub, a pump housing having an inner circumferential surface that defines a housing space and extends along a rotating direction of the impeller, the housing space being in fluid communication with the water introducing port and accommodating the impeller, a first circulation port that is connected to the first circulation pipe and has a first entrance hole in fluid communication with the housing space, a second circulation port that is connected to the second circulation pipe and has a second entrance hole in fluid communication with the housing space, the first circulation port being spaced apart from the second circulation port in the rotating direction of the impeller, wherein the inner circumferential surface of the pump housing includes:

an acute-angle area at which the first entrance hole and the second entrance hole are located, and a reflex-angle area that extends outside of the acute-angle area along the rotating direction of the impeller, wherein the pump housing comprises:

a cut-off portion located inward relative to the first entrance hole in a radial direction of the impeller, a rotating water current guide part that is located in the reflex-angle area and extends from the cut-off portion along the rotating direction of the impeller, and a biased water current guide part that is from the cut-off portion toward the first entrance hole.

2. The washing machine of claim 1, wherein the biased water current guide part extends in a biased direction that defines an angle with respect to the radial direction of the impeller.

3. The washing machine of claim 1, wherein the cut-off portion is spaced apart from the first entrance hole toward a center of rotation of the impeller.

4. The washing machine of claim 1, wherein the first circulation port and the second circulation port extend in parallel to each other.

5. The washing machine of claim 1, wherein the biased water current guide part defines an acute angle relative to a reference line parallel to the first circulation port in the rotating direction of the impeller.

6. The washing machine of claim 1, further comprising:

a cabinet that accommodates the tub therein and has a laundry entry hole at a front surface of the cabinet; and a gasket that connects the laundry entry hole to a tub opening defined at a front surface of the tub, wherein the first nozzle and the second nozzle are disposed at an inner circumferential surface of the gasket.

7. The washing machine of claim 6, wherein the first nozzle comprises a plurality of first nozzles, and the second nozzle comprises a plurality of second nozzles, and wherein the washing machine further comprises:

a first distribution pipe that is disposed outside of the gasket and connects the first circulation pipe to the plurality of first nozzles; and a second distribution pipe that is disposed outside of the gasket and connects the second circulation pipe to the plurality of second nozzles.

8. The washing machine of claim 1, further comprising a controller configured to control a direction of rotation of the pump motor.

9. A washing machine comprising:

a tub configured to receive water;

a drum disposed in the tub and configured to receive laundry;

a first nozzle and a second nozzle that are configured to spray water into the drum;

a pump configured to circulate water discharged from the tub, the pump comprising a first circulation port and a second circulation port that are configured to discharge water;

a first circulation pipe configured to guide, to the first nozzle, water discharged through the first circulation port; and a second circulation pipe configured to guide, to the second nozzle, water discharged through the second circulation port, wherein the pump comprises:

a pump motor configured to generate a torque;

an impeller configured to be rotated by the torque generated by the pump motor; and a pump housing that defines a housing space accommodating the impeller, the pump housing comprising the first circulation port in communication with the housing space, the second circulation port in communication with the housing space, and a water introducing port configured to guide, to the housing space, water discharged from the tub, wherein the pump housing has an inner circumferential surface that extends along a circumference of the impeller and that defines a first entrance hole in communication with the first circulation port and a second entrance hole in communication with the second circulation port, the first entrance hole and the second entrance hole being spaced apart by a predetermined acute angle about a center of rotation of the impeller, wherein the inner circumferential surface of the pump housing defines:

an acute-angle area that defines the first entrance hole and the second entrance hole, and a reflex-angle area that is disposed outside of the acute-angle area and that extends along a direction of rotation of the impeller, and wherein the pump housing further comprises:

a rotating water current guide part that extends along the reflex-angle area from a cut-off portion of the pump housing to the second entrance hole, the cut-off portion being configured to branch water in the housing space into a first flow running along the direction of rotation of the impeller and a second flow running toward the first entrance hole, and a biased water current guide part that is bent from the cut-off portion and that extends from the rotating water current guide part to the first entrance hole to thereby guide the second flow to the first circulation port.

10. The washing machine of claim 9, wherein the rotating water current guide part defines an angle greater than 180° with respect to the biased water current guide part.

11. The washing machine of claim 9, wherein the inner circumferential surface of the pump housing has an inner edge defined by the rotating water current guide part and the biased water current guide part.

12. The washing machine of claim 9, wherein the biased water current guide part extends from the cut-off portion in a biased direction that defines an angle with respect to a radial direction passing through the center of rotation of the impeller, and wherein the biased water current guide part defines an obtuse angle relative to the rotating water current guide part at the cut-off portion.

13. The washing machine of claim 9, wherein the first circulation port and the second circulation port extend in parallel to each other.

14. The washing machine of claim 9, further comprising a controller configured to control a direction of rotation of the pump motor.

15. A washing machine comprising:

a tub;

a drum disposed in the tub;

a first nozzle and a second nozzle that are configured to spray water into the drum;

a pump configured to circulate water discharged from the tub;

a first circulation pipe connected to the first nozzle and the pump; and a second circulation pipe connected to the second nozzle and the pump, wherein the pump comprises:

an impeller, a pump motor configured to rotate the impeller, a water introducing port connected to the tub, a pump housing that extends along a rotating direction of the impeller, the pump housing having a housing space accommodating the impeller, a first circulation port that is connected to the first circulation pipe and is in fluid communication with the housing space, and a second circulation port that is connected to the second circulation pipe and in fluid communication with the housing space, the first circulation port being spaced apart from the second circulation port in the rotating direction of impeller by an acute-angle about a center of rotation of the impeller, wherein the pump housing comprises:

a cut-off portion that is located farther from the second circulation port in the rotating direction than from the first circulation port, and a biased water current guide part that is bent from the cut-off portion toward the first circulation port, and wherein the first and second circulation ports are located at a same side with respect to a diameter line extending from the cut-off portion to an opposite side of the cut-off portion through the center of the impeller.

16. The washing machine of claim 15, wherein the cut-off portion of the pump housing protrudes from an inner circumferential surface of the pump housing toward the center of rotation of the impeller.

17. The washing machine of claim 15, wherein the cut-off portion is located inward relative to the first circulation port in a radial direction of the impeller.

18. The washing machine of claim 15, wherein the pump housing comprises:

a rotating water current guide part that extends from the cut-off portion along the rotating direction of the impeller.

19. The washing machine of claim 15, wherein the biased water current guide part extends from the cut-off portion to an entrance hole of the first circulation port in a biased direction that defines an angle with respect to a radial direction passing through the center of rotation of the impeller.

20. The washing machine of claim 19, wherein the biased direction intersects the radial direction at the cut-off portion of the pump housing.

* * * * *